United States Patent [19]

Economopoulos et al.

[11] Patent Number: 4,625,532

[45] Date of Patent: Dec. 2, 1986

[54] MANUFACTURING STEEL CONCRETE REINFORCEMENTS ON A HIGH SPEED ROD ROLLING MILL

[75] Inventors: Marios Economopoulos, Liege; Pierre Simon, Montegnee, both of Belgium

[73] Assignee: Centre de Recherches Metallurques-Centrum Voor Research in de Metallurgie, Brussels, Belgium

[21] Appl. No.: 631,787

[22] Filed: Jul. 17, 1984

[30] Foreign Application Priority Data

Jul. 18, 1983 [LU] Luxembourg ..... 84 922

[51] Int. Cl.[4] ..... B21B 45/02

[52] U.S. Cl. ..... 72/201; 148/12 B

[58] Field of Search ..... 72/39, 201; 148/12 B, 148/12.4, 156; 266/111, 113

[56] References Cited

U.S. PATENT DOCUMENTS 2,756,169 7/1956 Corson et al. ..... 148/156
4,016,009 4/1977 Economopoulos et al. ..... 148/12 B
4,120,455 10/1978 Wilmotte et al. ..... 72/201 X

FOREIGN PATENT DOCUMENTS 2102800 8/1972 Fed. Rep. of Germany ..... 72/39

*Primary Examiner*—E. Michael Combs
*Attorney, Agent, or Firm*—Holman & Stern

[57] ABSTRACT

Steel concrete-reinforcing rod is manufactured on a high speed rod rolling mill including a finisher followed by a cooling device for superficial quenching. The traction applied to the product leaving the finisher and approaching the cooling device is arranged to be appropriate to the correct advancement of the rod, by increasing the drive force of the rod and/or reducing the braking forces produced in the cooling device. Braking force in the cooling device can be reduced by introducing air into the cooling water.

5 Claims, 2 Drawing Figures

MANUFACTURING STEEL CONCRETE REINFORCEMENTS ON A HIGH SPEED ROD ROLLING MILL

BACKGROUND OF THE INVENTION

1. Field of the Invention

The present invention relates to the manufacture in a high speed rod rolling mill, of steel concrete-reinforcing rod, which can have both a high limit of elasticity and high ductility, and, if desired, good weldability; the manufacturing process involves a short cooling process applied during or immediately after rolling.

2. Description of the Prior Art

If the mill operator wishes to resolve the problem which has just been posed, he must take into account the various constraints imposed on him. In the first place, his rolling installation, in practice, determines the delivery speed and temperature of the rod; furthermore, the mill operator has limited space for the possible installation of a cooling device.

Particularly in the case of rod rolling mills, the delivery speed in modern installations is very high, of the order of a hundred meters per second.

From a metallurgical point of view, there are already several solutions available for reaching a compromise between the mechanical properties on the one hand and the cost price on the other hand.

A first solution consists in producing "naturally hard" steel reinforcements whose limit of elasticity is obtained by adding carbon (for example 0.35 wt. %) and manganese (for example 1.3 wt. %); these steels have an acceptable limit of elasticity (420 MPa), but their elongation and their aptitude for bending are relatively low and their weldability clearly insufficient.

In order to improve the weldability, it is necessary to decrease the carbon content, which results in a decrease in the limit of elasticity.

There are two known methods for compensating this decrease in the limit of elasticity.

The first consists in incorporating microalloying elements, such as niobium or vanadium in the steel. This technique is costly however, owing to the price of the alloying elements.

The second method is to increase the limit of elasticity of the steel, by means of cold deformation of the bar, in particular by twisting. Apart from the costs also incurred by an operation of this kind, the gain in the limit of elasticity is produced to the detriment of the elongation.

The method with which the present invention is concerned ranks among recent technology which consists in applying a short cooling process, which is limited in time, to the hot-rolled concrete-reinforcements, during or immediately after rolling, so as to produce a surface layer of martensite in the bar; this "quenching" is followed by a cooling process during which the core of the bar, i.e. the part not affected by the short cooling process, is transformed into ferrite and carbides. By carefully limiting the duration of the short cooling process, it is further possible to preserve the heat in the core of the bar and to produce in its cross-section a temperature gradient such that, during the said subsequent cooling process, tempering of the surface layer of martensite is produced. The duration of the short cooling process can be carefully limited in this way by ensuring that a determined core temperature, at the end of the short cooling phase, is achieved; in practice, such an operation can be carried out by observing the surface temperature at the point on the bar at which reheating, as a result of the supply of heat coming from the core, is observed.

A method of this type, commonly called "quenching and self-tempering", can in theory be carried out—in an installation determined in accordance with the known specifications for manufacturing specific reinforcements—on the basis of the feature of the "core" temperature at the end of the short cooling phase.

However, it is understood that implementing the operation has various difficulties depending on the speed of advance of the products on the one hand and their diameter on the other hand.

At the present stage, although the manufacture of reinforcements of this type no longer poses any difficulty when processing bars having a minimum diameter of 6 mm, the case is different on rod rolling mills operating at high speed; in an installation of this type, the use of intense water cooling devices actually produces disturbing effects with respect to the displacement of the product.

SUMMARY OF THE INVENTION

Before describing the present invention, which makes it possible to resolve the problem which has just been explained, it is useful briefly to recall that in an installation for hot-rolling and heat treating a rod, there is usually a so-called "finisher" disposed at the outlet of the intermediate rolling mill, a cooling device situated at the outlet of the finisher, and a drive device, generally having rollers, for extracting the rod from the installation. An installation of this type is shown diagrammatically in FIG. 1.

The drive device is normally capable of exerting a traction with a value T, but in order for the rolling operation to proceed correctly, it is necessary that the traction X exerted on the rod downstream of the finisher is greater than a minimum value suitable for driving the rod out of the finisher.

The traction X, at the outlet of the finisher, is actually the difference beteen the traction force T of the drive device and the braking force F applied to the rod principally when it passes into the cooling device.

In fact, experiments carried out have made it possible to establish that the braking force F is a function K of the length L of the cooling device (or $F=K.L$), the coefficient K in turn being a function of the nature of the cooling device, of the flow rate of the cooling fluid and of the relative speed of the rod with respect to the cooling fluid.

The problem associated with the rod rolling mill became clear when, under conditions capable of ensuring the quenching and self-tempering of the product, whilst using cooling devices conventionally used in rod rolling mills, the traction X proved to be too weak for operating at high speed and the rod was systematically "piled up" between the outlet of the finisher and the inlet into the cooling device.

What was therefore desired was an improved installation enabling a quenching/self-tempering process capable of ensuring that the rod has an optimum combination of limit of elasticity and elongation, to be applied to the rod which advances at a high speed.

The present invention provides a method of manufacturing steel concrete reinforcements, on a high speed rod rolling mill, in which there is applied to the product leaving the finisher block of a hot rolling mill, and before the rod enters the cooling device, a traction appropriate to the correct advancement of the product, by increasing the drive force of the rod and/or reducing the barking forces produced in the cooling device for this purpose.

In one mode of operation of the present invention one applies to the product, upstream of the finisher and/or in the finisher, a cooling process for lowering the temperature of the rod at the outlet of the finisher to below the normal temperature, i.e. the temperature achieved when cooling is applied to the finisher solely for obtaining a substantially constant temperature in the finisher, for example.

This additional cooling process, upstream of or in the finisher, results in an increase of the rigidity of the rod at the outlet of the finisher, and thus in a reduction of the minimum traction necessary for the operation to proceed satisfactorily; moreover, the minimum length of the cooling bank necessary for quenching is shortened, which reduces the value of the braking force F.

Thus, a decrease in the end-of-rolling temperature from 1050° C. to 950° C. allows the quenching length L of the rod to be decreased by 30%.

A second mode of operation of the present invention is to use a cooling device having a low braking coefficient K.

In a first preferred variant according to the invention, the cooling fluid consists of a water/air mixture, which is more compressible and therefore has less of a braking effect than the water which is usually used; under these conditions, although the coefficient K decreases effectively, the length L necessary for the quenching operation must be increased, given that the specific capacity of the cooling operation is lowered; it is, however, observed that in the end of the product $K \times L$, i.e. the braking force, was lower.

According to a second preferred embodiment of the invention, cooling devices provided with helical injection slots, of a type which is disclosed in Belgian Pat. No. 867 299, are used.

Owing to the use of one and/or other of these devices, not only is the braking force decreased but in addition better stability of the rod in the installation is ensured, which reduces the necessary minimum traction value $T_{min}$ at the outlet of the finisher.

A third mode of operation of the present invention is to increase the pull force T produced by the drive device.

According to a preferred embodiment for putting this into effect, the power available in the drive device is increased; according to a second embodiment, which can be associated with the first, a plurality of pairs of drive rollers are used, which are possibly staggered with respect to each other in terms of level, thereby forcing the rod to follow an undulating path in the drive device.

BRIEF DESCRIPTION OF DRAWINGS

The invention will be described further, with reference to the accompanying drawings, in which.

DETAILED DESCRIPTION

Figure 1:
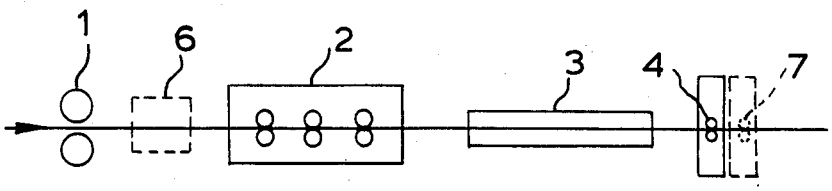
FIG. 1 is a schematic illustration of a high speed rod rolling mill.

FIG. 1 shows in solid lines the elements which constitute the usual end-of-rolling installation. In the direction of travel of the rod there are the intermediate rolling mill 1, the finisher 2, the intense cooling device, or "quenching canon" 3 and the roller drive device 4. Between the finisher 2 and the canon 3, the traction X on the rod is equal to the difference between the force T exerted by the drive device 4 and the braking force F to which the rod is subjected, principally in the canon 3 (i.e. $X=T-F$).

This FIG. 1 shows in broken line two improvements: a device 6 for cooling the rod at the inlet of the finisher 2, and additional drive rollers 7.

Figure 2:
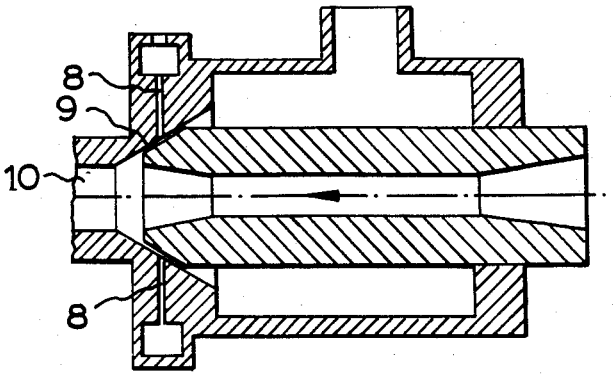
FIG. 2 is a cross-sectional view taken through the longitudinal axis of a cooling device of the mill.

FIG. 2 shows an intense water-air cooling device or canon which provides the particular feature of low internal braking, on account of the compressibility of the fluid (gas/liquid mixture) flowing in this device. Air intake channels 8 open into an annular slot 9 (supplied with water by an annular reservoir) for injection into the rod conduit 10 of the canon; the injection of the water-air mixture takes place in the direction of travel of the rod.

In an advantageous variant, this cooling device is equipped with means for regulating its cooling capacity, for example for modifying the relation between the water flow rate and the air flow rate, or else the temperature of the water.

The method described above can be used to manufacture both smooth and ribbed reinforcements, which are used either actively or passively in strengthening concrete structures and may be used in trelliswork.

We claim:

1. In a method of manufacturing a steel concrete-reinforcing rod wherein the rod is passed through finishing stands of a high speed rod mill and is subjected to preliminary cooling before the finishing stands and to surface quenching immediately after its exit from the finishing stand, the quenching step being carried out in a water flow whose speed is substantially lower than the speed of the rod and being followed by a self-tempering step, the improvement for reducing the braking force caused by the quenching step comprising:

cooling the rod during said preliminary cooling so that the temperature of the rod at the exit of the finishing stands is between 1050° C. and 950° C.;

forming an annular flow of water around the rod exiting from the finishing stands;

introducing air into said annular flow of water to increase the compressibility of the coolant flow of water; and applying said annular flow of water containing air to the outer surface of the moving rod at an acute angle in the direction in which the rod is moving.

2. A method as claimed in claim 1, wherein a traction force is applied to the rod downstream of the quenching step, and further comprising increasing the traction force applied to the wire rod in an amount sufficient to ensure minimum traction force in the finishing stands over the braking force caused by the quenching step.

3. A method as claimed in claim 1 wherein:

said temperature is between 950° C. and 975° C.

4. A method as claimed in claim 2 wherein:

said temperature is between 950° C. and 975° C.

5. In a high speed rod rolling mill for manufacturing steel concrete-reinforcing rods including a hot rolling finisher upstream and adjacent a cooling device for quenching the moving rod exiting from the finishing device, the improvement wherein the cooling device comprises:

a housing member having a cooling water chamber therein;

a hollow tubular conduit through which the moving rod travels disposed substantially centrally through said cooling chamber;

an outlet at one end of the housing having an outlet opening coaxially aligned with said tubular conduit downstream thereof;

a conical annular space between the outlet end of the tubular conduit and the housing communicating with the cooling chamber for passing water therethrough from the cooling chamber to the outer surface of the moving rod at an acute angle in the direction in which the rod is moving; and air channels through said housing opening into said conical annular space to facilitate feeding of air into the water passing through said space to produce a more compressible coolant for reducing the braking effect of the water on the moving rod as it passes through the cooling device.

* * * * *